United States Patent [19]

Akamatsu

[11] 4,077,711

[45] Mar. 7, 1978

[54] ELECTROPHOTOGRAPHIC COPYING APPARATUS OF WET DEVELOPING TYPE

[75] Inventor: Hiroyuki Akamatsu, Tokyo, Japan

[73] Assignee: Ricoh Company, Ltd., Japan

[21] Appl. No.: 581,560

[22] Filed: May 28, 1975

[30] Foreign Application Priority Data

May 28, 1974 Japan ..... 49-59901

[51] Int. Cl.[2] ..... G03G 15/10

[52] U.S. Cl. ..... 355/10; 118/652; 355/15; 427/15

[58] Field of Search ..... 355/1, 10, 15; 427/15; 118/652, 659

[56] References Cited

U.S. PATENT DOCUMENTS

| | | | |
|---|---|---|---|
| 3,630,605 | 12/1971 | Lock | 355/1 |
| 3,637,306 | 1/1972 | Cooper | 355/15 |
| 3,647,293 | 3/1972 | Queener | 355/15 |
| 3,711,796 | 1/1973 | Saito et al. | 355/10 X |
| 3,741,643 | 6/1973 | Smith et al. | 355/10 |
| 3,752,119 | 8/1973 | Matkan | 427/15 X |
| 3,758,204 | 9/1973 | Mochizuki | 355/10 |
| 3,776,632 | 12/1973 | Smith et al. | 355/10 X |
| 3,834,803 | 9/1974 | Tsukada | 355/1 |
| 3,907,423 | 9/1975 | Hayashi et al. | 355/10 |
| 3,918,808 | 11/1975 | Narita | 355/15 |
| 3,927,937 | 12/1975 | deKeyzer | 355/15 |

FOREIGN PATENT DOCUMENTS

| | | | |
|---|---|---|---|
| 1,943,166 | 3/1970 | Germany | 355/10 |

*Primary Examiner*—Fred L. Braun
*Attorney, Agent, or Firm*—McGlew and Tuttle

[57] ABSTRACT

The copying apparatus is of the so-called visual image transfer type, in which a developing solution including toner dispersed in a carrier liquid is used for both developing and cleaning purposes. A cleaning device, having a roller and/or doctor blade, is disposed beneath a rotatable photosensor drum and developing and transfer-printing devices are disposed upstream and downstream, respectively, of the cleaning device with respect to the rotating direction of the drum. The cleaning device is brought into engagement with the drum surface after each transfer-printing has been effected and supplied with developing solution, as a cleanser, from the developing device to easily remove residual toner from the drum surface. A bundle of light focussing glass fibres is used as an exposure optical scanning device in order to make the apparatus into a compact structure. The drum makes two rotations during each copying cycle, with the drum being discharged and cleaned during the second rotation.

8 Claims, 3 Drawing Figures

ELECTROPHOTOGRAPHIC COPYING APPARATUS OF WET DEVELOPING TYPE

BACKGROUND OF THE INVENTION

The invention relates to a wet electrophotographic copying apparatus of the so-called visual image transfer type.

Referring to FIG. 1, which illustrates a typical example of a conventional wet electrophotographic copying apparatus of the type described, it essentially comprises a so-called photosensor drum 1, such as an electrically conductive drum on the periphery of which a layer of photoconductive material is disposed; a series of discrete processing units located along the periphery of the drum, including a corona discharge changer C1; an exposure optical system *m*1, *m*2, *m*3 and *m*4; a wet developing unit 2; a transfer 3 for transferring a visual image onto a recording sheet S; an a.c. corona charger C2 for removing the electric charge on the surface of the photosensor drum 1; a quenching lamp 5 for removing the residual charge within the layer of photoconductive material; a cleaning blade 6; an original receptacle 7 for carrying an original O thereon; and a light source 8 for illuminating the original.

With the apparatus described, a copying operation proceeds as follows: Initially, the photosensor drum 1 is rotated in the counterclockwise direction, and its surface is uniformly charged by the charger C1. Then the original receptacle 7 having an original O placed thereon is moved in the direction indicated by an arrow to be illuminated by the light from the light source 8, whereupon the reflected light from the original O is conveyed by the stationary optical system *m*1, *m*2, *m*3 and *m*4 onto the uniformly charged surface of the photosensor drum 1, thereby focussing an image corresponding to the original O thereon. In this manner, an electrostatic latent image is formed on the surface of the drum 1 in conformity to the original O. The latent image is converted into a visual image by a supply of a developing solution thereto at the wet developing unit 2. Subsequently, the visual image is transferred onto a recording sheet S at the transfer unit 3, thus providing a copy sheet. Subsequent to the transfer of the visual image onto the recording sheet S, the electric charge remaining on the surface of the photosensor drum 1 is removed by the a.c. corona charger C2, and the charge remaining within the photoconductive layer is removed by the quenching lamp 5.

Of primary importance in the wet electrophotographic apparatus described above is the cleaning step which removes any residual toner on the surface of the photosensor drum 1 after the visual image has been transferred onto the recording sheet S. If the residual toner is allowed to remain on the surface of the drum without removal, it may mar the recording sheet or may cause a degradation in the performance of the photosensor drum during the next copying cycle.

In the electrophotographic copying apparatus described, the residual toner is removed by disposing the edge of the cleaning blade 6 in abutting engagement with the surface of the drum 1. It will be appreciated that, in the copying apparatus of the type described, the location for the cleaning operation is limited to being intermediate the transfer position for the visual image and the position of the charger C1 where renewed charging of the drum surface is effected, so that it follows that the cleaning blade 6 must be located above the developing unit 2. A liquid cleanser is supplied adjacent to the edge of the cleaning blade 6 where it bears against the drum surface in order to avoid accumulation of toner, as separated from the drum surface, adjacent to the edge of the cleaning blade and to prevent the blade 6 from causing damage to the drum surface. Usually, the liquid cleanser comprises the developing solution itself which comprises toner disposed in a carrier liquid such as Isopay (trade name). As a result, in the electrophotographic copying apparatus as shown in FIG. 1, it is necessary to provide means which supplies the liquid cleanser or developing solution adjacent to the cleaning blade 6.

The supply of the liquid cleanser to a location above the transfer unit 3 may cause a flow of the liquid cleanser toward the transfer unit 3, thereby resulting in a disadvantageous marring of the recording sheet S. Additionally, the location of the cleaning station at a position above the charger C1 may also cause a flow of the liquid cleanser toward the latter, again causing a marring thereof or preventing a uniform charging as a result of the liquid flow. In particular, where the exposure optical system comprises a bundle of light focussing glass fibres, the location of the optical system is substantially limited to a region adjacent to the top of the photosensor drum, so that the photosensor drum 1 presents a downwardly declining surface in a region from the cleaning blade 6 to the transfer unit 3, thus requiring provision for preventing a flow of the liquid cleanser into the transfer unit 3. This results in a complex arrangement.

SUMMARY OF THE INVENTION

In view of the foregoing, it is an object of the invention to provide an electrophotographic copying apparatus in which a developing solution available from a developing unit is supplied, as a liquid cleanser for cleaning purposes or the removal of residual toner from a photosensor drum, at a location below the developing unit and a transfer unit.

It is another object of the invention to provide an electrophotographic copying apparatus which is made as a compact overall structure by the use of a bundle of light focussing fibres for an exposure optical system.

DETAILED DESCRIPTION OF A PREFERRED EMBODIMENT

Figure 2:
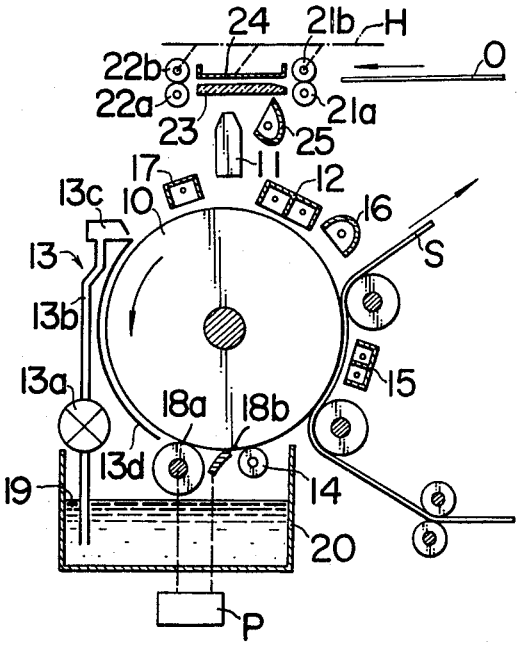
FIG. 2 is a similar schematic view of the electrophotographic copying apparatus according to one embodiment of the invention.

FIG. 2 shows a schematic view of the essential parts of the electrophotographic copying apparatus constructed according to one embodiment of the invention. Specifically, the apparatus comprises a photosensor drum 10 having a photosensitive peripheral surface; a bundle of light focussing fibres 11 which is used as an exposure optical system; a charger 12; a developing unit 13; a squeeze roll 14; a transfer unit 15; a quenching lamp 16; an a.c. corona charger 17; a cleaning roll 18*a* and a cleaning blade 18*b* serving as cleaning members; a tank 20 for containing a supply of a developing solution 19; pairs of feed rollers 21*a*, 21*b*, 22*a*, 22*b* for conveying an original O; a contact glass 23, a guide 24; and a lamp 25 used as a light source.

The photosensor drum 10 comprises an electrically conductive drum on the peripheral surface of which is disposed a layer of photoconductive material, and is adapted to be rotated counterclockwise, namely, in the direction indicated by an arrow.

Figure 1:
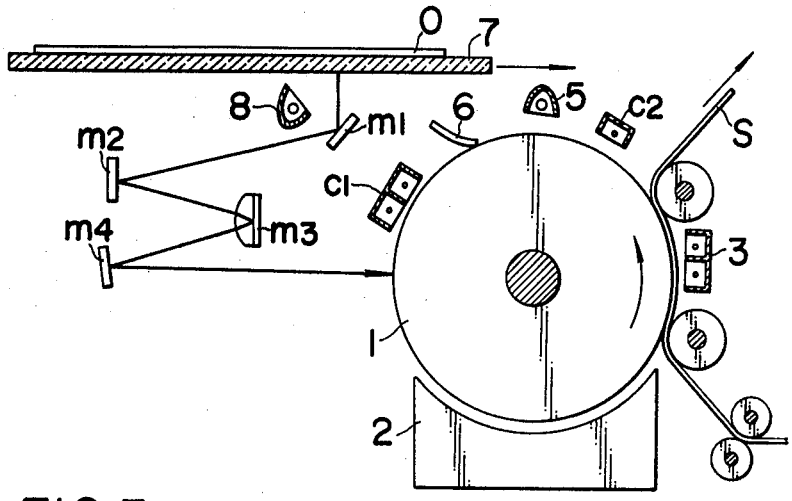
FIG. 1 (PRIOR ART)
FIG. 1 is a schematic view of a conventional wet electrophotographic copying apparatus of visual image transfer type.
Figure 3:
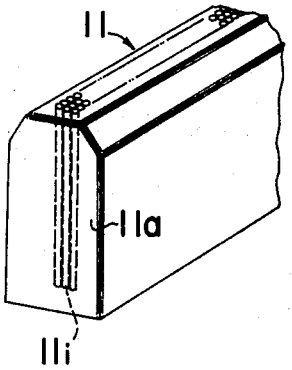
FIG. 3 is a perspective view of the bundle of light focussing fibres shown in FIG. 2.

As shown in FIG. 3, the bundle of the light focussing fibres 11 which is used as the exposure optical system comprises a number of light focussing glass fibres 11*i* of a given length bundled together in prarallel alignment so that their end faces collectively form a slit-like surface, the fibres being bonded together by resin lla, (for further detail, reference is made to Japanese Laid-Open Application No. 5337/1974). The fibres may comprise SELFOX (trade mark). This material has a refractive index which varies in the radial direction in a symmetrical manner with respect to the axis of the fibre. Thus, denoting the refractive index at the axis by $n_O$, the refractive index n at a radius y is given by the following expression:

$$n = n_O(1 - \tfrac{1}{2} Ay^2) \quad (1)$$

As a consequence, the path of light propagating in the lengthwise direction of the fibre (which is chosen as the x-direction) is defined by the following differential equation:

$$d_2y/dx^2 = -Ay \quad (2)$$

The light propagates in a sinusoidal trajectory with a period of $2\pi/\sqrt{A}$ which is determined by the constant A appearing in the equation (1). An important choice in this respect is that the length of the respective fibres is chosen equal to $(n + 0.5)$ times the period, $n$ being an integer including zero. Then the individual fibres are equivalent to a lens system which forms an erect one-fold image. Because the focal distance is generally very small, the length of the exposure path can be minimized, enabling the overall copying apparatus to be made as a compact structure. As shown in FIG. 2, the location of the fibre bundle 11 will be limited adjacent to the top of the drum 10, which is convenient for practical purposes.

The developing unit 13 is formed as a so-called liquid cascade developing unit, and comprises a pump 13*a*, which pumps the developing solution 19 contained within the tank 20 into a supply pipe 13*b* connected with a discharge port means 13*c* for permitting flow of the developing solution into the narrow channel defined between the drum 10 and a facing means in the form of a counter-electrode 13*d* for the purpose of developing. The squeeze roll 14 has its surface located very close to the surface of the drum 10, and is rotated counter-clockwise to remove an excess amount of the developing solution from the drum surface and to return it into the tank 20.

The transfer unit 15 operates to transfer a visual toner image which is formed on the drum 10 onto a recording sheet S. The quenching lamp 16 irradiates the drum surface, subsequent to the transfer of the visual image onto the sheet S, for discharging the electric charge that has been trapped within the photoconductive layer of the drum 10. The a.c. corona charger 17 neutralizes the charge of the electrostatic latent image which may remain partly on the surface of the drum.

The cleaning roll 18*a* comprises a porous elastomer, and is brought into abutting relationship against the drum surface together with the cleaning blade 18*b* under the control of releaseable pressure means P.

Of the pairs of feed rollers, the rollers 21*b* and 22*b* can be moved out of contact with their mating rollers as required. Also the guide 24 can be moved away from the contact glass 23. These movements can be accomplished by pivotally mounting these members 21*b*, 22*b* and 24 by hinges illustrated at H. When the original O is in the form of a sheet, the original is scanned by passing it between the contact glass 23 and the guide 24 by means of the pairs of feed rollers 21*a*, 21*b*, 22*a* and 22*b* as shown in FIG. 2. Where the original O is a page of a book, the rollers 21*b* and 22*b* and the guide 24 can be moved to an upper retracted position, as viewed in FIG. 2, and the scanning of the original is achieved by placing the latter on a carrier (not shown) which may comprise a plate of a transparent material and conveying it by means of the rollers 21*a* and 22*a*.

In the operation, the photosensor drum 10 is set in motion, and the charger 12 uniformly charges the surface thereof. In the meantime, the original O is fed into the nip between the feed rollers 21*a*, 21*b* and the lamp 25 is energized for scanning, through the fibre bundle 11, the surface of the original as it moves through the passage defined between the contact glass 23 and the guide 24, thereby forming an electrostatic latent image corresponding to the original O on the drum surface.

The a.c. corona charger 17 remains inoperative at this time and, as the drum 10 further rotates, the latent image is converted into a visual image through a liquid cascade developing process which is performed by the developing unit 13. At this time, both the cleaning roll 18*a* and the cleaning blade 18*b* are freed from contact with the drum 10. Subsequently, an excess amount of developing solution is removed from the surface of the drum 10 by means of the squeeze roll 14, and the visual image is transferred onto the recording sheet S at the transfer unit 15, thus producing a copy image on the sheet S.

Subsequent to the transfer of the visual image onto the sheet S, the electric charge within the photoconductive layer of the drum 10 is discharged by irradiation from the quenching lamp 16. Before a renewed scanning of the original, the application of corona discharge voltage to the charger 12 is interrupted and the lamp 25 is deenergized, while a discharge voltage is applied to the a.c. corona charger 17 during a subsequent rotation of the drum 10. The control of the charger 12, of the lamp 25, and the a.c. corona charger 17 may be effected in the usual manner known to those skilled in the art, such as by the provision of suitable switches or the like which may be operated either automatically or manually. Thereupon, any residual charge remaining on the drum surface is discharged by the a.c. corona discharge, whereby any remaing toner on the drum surface will be flushed away, in part, into the tank 20 by the developing solution as supplied from the unit 13, while its remainder will be rendered in a readily separable condition for removal from the drum surface, by a wiping action of the cleaning roll 18*a* and the cleaning blade 18*b* which are brought into abutting relationship against the drum surface 10 when the discharged surface area of the drum has moved opposite to the lower end of the counterelectrode 13*d*. Thus, the drum surface will be in a cleaned condition free from any residual toner when the drum 10 further continues to rotate. Where no home or start position is defined for the drum 10, and a copying process can be initiated from any position thereof, the drum is immediately available to the next copying operation. On the other hand, where a home position is defined for the drum 10, it is only necessary that it rotates to such home position before it becomes ready to initiate the next copying process. In this manner, a copy is obtained for each process mentioned above.

From the foregoing description, it will be apparent that the invention has provided an electrophotographic copying apparatus which permits the developing solution supplied from the developing unit to be used as a liquid cleanser for cleaning the photosensor drum. With the apparatus, a marring of the recording sheet by the liquid cleanser is avoided and, since the drum surface is flushed by the developing solution, the cleaning member or blade need not be strongly urged against the photosensor, thus minimizing damage to the photosensor drum. It will be appreciated that the invention can equally be applied to a belt-shaped photosensor.

What is claimed is:

1. An electrophotographic copying apparatus of the wet type in which developing is effected with a developing solution including toner dispersed in a carrier liquid, comprising, a. photosensor means, having a photosensitive surface, adapted to circulate around a horizontal axis in one direction twice during each copying operation;

b. an exposure optical system for scanning an original document to produce an electrostatic latent image thereof on said surface;

c. cleaning means disposed beneath said photosensor means and engageable with said surface for removing residual toner therefrom;

d. developing means disposed laterally adjacent said photosensitive surface at a substantially higher level than, and upstream of, said cleaning means, with respect to the circulating direction of said surface, and operable to direct a flow of said developing solution against said photosensitive surface, for developing said latent image with said solution, with the developing solution flowing downwardly along said photosensitive surface to said cleaning means to serve as a cleansing solution therefor; and e. transfer-printing means disposed downstream of said cleaning means, with respect to the circulating direction of said surface, for transfer-printing the developed toner image onto copy sheets;

f. said exposure optical system, said developing means and said transfer-printing means being operative, and said cleaning means being retracted from said photosensitive surface during the first circulation of said photosensor means, to produce a copy of the original documents;

g. said exposure optical system and said transfer printing means being inoperative, and said cleaning means being engaged with said photosensitive surface, during the second circulation of said photosensor means, for flushing of some toner from said photosensitive surface by the developing solution supplied by said developing means and removal of the remaining toner by said cleaning means.

2. An apparatus as in claim 1, wherein said developing means comprises discharge port means for discharging developing solution and means extending from said port means to said cleaning means, in facing spaced relation to said photosensitive surface, to define, together with said photosensitive surface, a narrow channel therebetween for directing a flow of the developing solution from said port means through said channel onto said cleaning means, to serve as a cleanser therefor.

3. An apparatus as in claim 2 wherein said facing means has a voltage applied thereto during developing, thereby serving as a counter-electrode.

4. An apparatus as in claim 2 wherein said cleaning means comprises a roller disposed near the outlet of said channel and a doctor blade disposed in following relation to said roller.

5. An apparatus as in claim 2, further comprising a receptacle disposed beneath said cleaning means for receiving developing solution removed from said surface and circulation means for circulating developing solution between said receptacle and said port means.

6. An apparatus as in claim 1 wherein said cleaning means comprises a roller having an outer layer of porous resilient material.

7. An apparatus as in claim 1 wherein said optical system comprises a bundle of light focussing fibres having end surfaces facing the original document and said photosensitive surface, respectively.

8. An electrophotographic copying apparatus of the wet type in which developing is effected with a developing solution including toner dispersed in a carrier liquid, comprising:

a. Photosensor means, having a photosensitive surface, adapted to circulate around a horizontal axis in one direction twice during each copying operation;

b. means, including an exposure optical system for scanning an original document, for forming an electrostatic latent image of the document on said surface;

d. cleaning means disposed beneath said photosensor means for removing residual toner therefrom;

d. developing means disposed laterally adjacent said photosensitive surface at a substantially higher level than, and upstream of, said cleaning means, with respect to the circulation direction of said surface, and operable to direct a flow of said developing solution against said photosensitive surface, for developing said latent image with said solution, with the developing solution flowing downwardly along said photosensitive surface to said cleaning means to serve as a cleaning solution therefor;

e. transfer-pringing means disposed downstream of said cleaning means with respect to the circulating direction of said surface, for transfer-printing the developed toner image onto copy sheets; and f. erasing means disposed downstream of said transfer-printing means, with respect to the circulating direction of said surface, for erasing residual charges on said surface after each transfer-printing has been effected;

said latent image forming means, said developing means and said transfer-printing means being operative, and said cleaning means being retracted from said photosensitive surface, and said erasing means being inoperative, during the first circulation of said photosensor means, to produce a copy of the original document;

h. said latent image forming means and said transfer-printing means being inoperative, and said cleaning means being engaged with said photosensitive surface and said erasing means being operative, during the second circulation of said photosensor means, for flushing of some toner from said photosensitive surface by the developing solution supplied by said developing means and removal of the remaining toner by said cleaning means.

* * * * *